US009818282B2

(12) United States Patent
Burton et al.

(10) Patent No.: US 9,818,282 B2
(45) Date of Patent: Nov. 14, 2017

(54) WEARABLE SENDS MESSAGE ON FALL WHEN WORN

(71) Applicant: Plantronics, Inc., Santa Cruz, CA (US)

(72) Inventors: Joe Burton, Los Gatos, CA (US); Timothy P Johnston, Los Gatos, CA (US); Shantanu Sarkar, San Jose, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 14/485,509

(22) Filed: Sep. 12, 2014

(65) Prior Publication Data

US 2016/0078739 A1 Mar. 17, 2016

(51) Int. Cl.

| | |
|---|---|
| ***G08B 1/08*** | (2006.01) |
| ***G08B 21/04*** | (2006.01) |
| ***G08B 25/08*** | (2006.01) |
| ***G08B 25/10*** | (2006.01) |

(52) U.S. Cl.

CPC ..... *G08B 21/0446* (2013.01); *G08B 25/08* (2013.01); *G08B 25/10* (2013.01)

(58) Field of Classification Search

CPC ..... G08B 21/0446; G08B 21/0453
USPC ..... 340/539.1–539.13
See application file for complete search history.

(56) References Cited

U.S. PATENT DOCUMENTS 6,819,247 B2 * 11/2004 Birnbach ..... A61B 5/0002 340/539.11
8,952,818 B1 * 2/2015 Zhang ..... G08B 21/0446 340/573.1
9,110,498 B2 * 8/2015 Martinez ..... A61B 5/681
2009/0322540 A1 * 12/2009 Richardson ..... A61B 5/0002 340/573.7
2013/0054180 A1 * 2/2013 Barfield ..... G01P 15/0891 702/138
2013/0143519 A1 * 6/2013 Doezema ..... G08B 21/0446 455/404.2
2013/0307685 A1 * 11/2013 Sholder ..... G08B 21/02 340/539.12
2014/0135612 A1 * 5/2014 Yuen ..... A61B 5/02405 600/407

(Continued)

OTHER PUBLICATIONS

Jia, "Detecting Human Falls with a 3-Axis Digital Accelerator," Analog Dialog 43(7):1-7 (Jul. 2009).

(Continued)

*Primary Examiner* — Eric M Blount
(74) *Attorney, Agent, or Firm* — Jeremy S. DesRosier

(57) ABSTRACT

Wearable electronic communication devices having corresponding methods and computer-readable media comprise: an accelerometer; a don/doff detector; a transmitter; a processor configured to i) determine whether the wearable electronic communication device has experienced a fall based on information produced by the accelerometer, ii) determine whether the wearable electronic communication device was being worn during the fall based on information produced by the don/doff detector, and iii) cause the transmitter to transmit a message from the wearable electronic communication device responsive to the processor determining both i) the wearable electronic communication device has experienced a fall and ii) the wearable electronic communication device was being worn during the fall.

20 Claims, 3 Drawing Sheets

(56) References Cited

U.S. PATENT DOCUMENTS

| | | | | |
|---|---|---|---|---|
| 2014/0155705 | A1* | 6/2014 | Papadopoulos | A61B 5/0022 600/301 |
| 2014/0313036 | A1* | 10/2014 | Sweeney | G08B 21/0446 340/573.1 |
| 2015/0092520 | A1* | 4/2015 | Robison | G04G 21/02 368/9 |
| 2015/0220109 | A1* | 8/2015 | Von Badinski | G06F 1/16 340/539.12 |
| 2015/0223731 | A1* | 8/2015 | Sahin | A61B 5/7282 600/301 |
| 2015/0238150 | A1* | 8/2015 | Subramaniam | A61B 5/74 340/539.11 |

OTHER PUBLICATIONS

Unknown, "Health Care—Fall Detection—Sensor-based applications," found at URL <http://www.sense-os.nl/-/health-care-fall-detection> on Aug. 4, 2014.

Unknown, "Philips Lifeline," found at URL <http://www.lifelinesys.com/content/> Aug. 4, 2014.

Yavuz et al., "A Smartphone Based Fall Detector with Online Location Support," In Proceedings of PhoneSense 2010, Nov. 2010.

* cited by examiner

WEARABLE SENDS MESSAGE ON FALL WHEN WORN

FIELD

The present disclosure relates generally to the field of electronic communications. More particularly, the present disclosure relates to wearable devices for automatically transmitting a message on detecting the user has fallen.

BACKGROUND

A person who has fallen may be unable to call for help. For example, the person may be unconscious. Even if conscious, the person may be unable to move, unable to reach a phone, or the like.

SUMMARY

In general, in one aspect, an embodiment features a wearable electronic communication device comprising: an accelerometer; a don/doff detector; a transmitter; a processor configured to i) determine whether the wearable electronic communication device has experienced a fall based on information produced by the accelerometer, ii) determine whether the wearable electronic communication device was being worn during the fall based on information produced by the don/doff detector, and iii) cause the transmitter to transmit a message from the wearable electronic communication device responsive to the processor determining both i) the wearable electronic communication device has experienced a fall and ii) the wearable electronic communication device was being worn during the fall.

Embodiments of the wearable electronic communication device can include one or more of the following features. In some embodiments, the message is a first message; and the first message instructs a connected device to transmit a second message. Some embodiments comprise a memory configured to store a phone number; wherein the message instructs a connected device to call the phone number. In some embodiments, the processor is further configured to determine a severity of the fall based on the information produced by the accelerometer. In some embodiments, the transmitter is further configured to transmit the message only responsive to the determined severity of the fall exceeding a threshold severity. In some embodiments, the message includes information representing the severity of the fall. In some embodiments, the message includes information that represents a location. Some embodiments comprise a biometric sensor; wherein the message includes information collected by the biometric sensor. In some embodiments, the processor is further configured to a) cause the wearable electronic communication device to prompt a user to cancel transmission of the message, and b) cause the transmitter to transmit the message responsive to the user not cancelling transmission of the message. In some embodiments, the wearable electronic communication device is a headset.

In general, in one aspect, an embodiment features a computer-readable media embodying instructions executable by a computer in a wearable electronic communication device to perform functions comprising: determining whether the wearable electronic communication device has experienced a fall based on information produced by an accelerometer of the wearable electronic communication device; determining whether the wearable electronic communication device was being worn during the fall based on information produced by a don/doff detector of the wearable electronic communication device; and causing a transmitter of the wearable electronic communication device to transmit a message from the wearable electronic communication device responsive to determining both i) the wearable electronic communication device has experienced a fall and ii) the wearable electronic communication device was being worn during the fall.

Embodiments of the computer-readable media can include one or more of the following features. In some embodiments, the message is a first message; and the first message instructs a connected device to transmit a second message. In some embodiments, the functions further comprise: storing a phone number in a memory of the wearable electronic communication device; wherein the message instructs a connected device to call the phone number. In some embodiments, the functions further comprise: determining a severity of the fall based on the information produced by the accelerometer. In some embodiments, the functions further comprise: transmitting the message only responsive to the determined severity of the fall exceeding a threshold severity. In some embodiments, the message includes information representing the severity of the fall. In some embodiments, the message includes information that represents a location. In some embodiments, the message includes information collected by a biometric sensor of the wearable electronic communication device. In some embodiments, the functions further comprise: causing the wearable electronic communication device to prompt a user to cancel transmission of the message, and causing the transmitter to transmit the message only responsive to the user not cancelling transmission of the message.

In general, in one aspect, an embodiment features a method for a wearable electronic communication device, the method comprising: determining whether the wearable electronic communication device has experienced a fall based on information produced by an accelerometer of the wearable electronic communication device; determining whether the wearable electronic communication device was being worn during the fall based on information produced by a don/doff detector of the wearable electronic communication device; and transmitting a message from the wearable electronic communication device responsive to determining both i) the wearable electronic communication device has experienced a fall and ii) the wearable electronic communication device was being worn during the fall.

The details of one or more implementations are set forth in the accompanying drawings and the description below. Other features will be apparent from the description and drawings, and from the claims.

Figure 1:
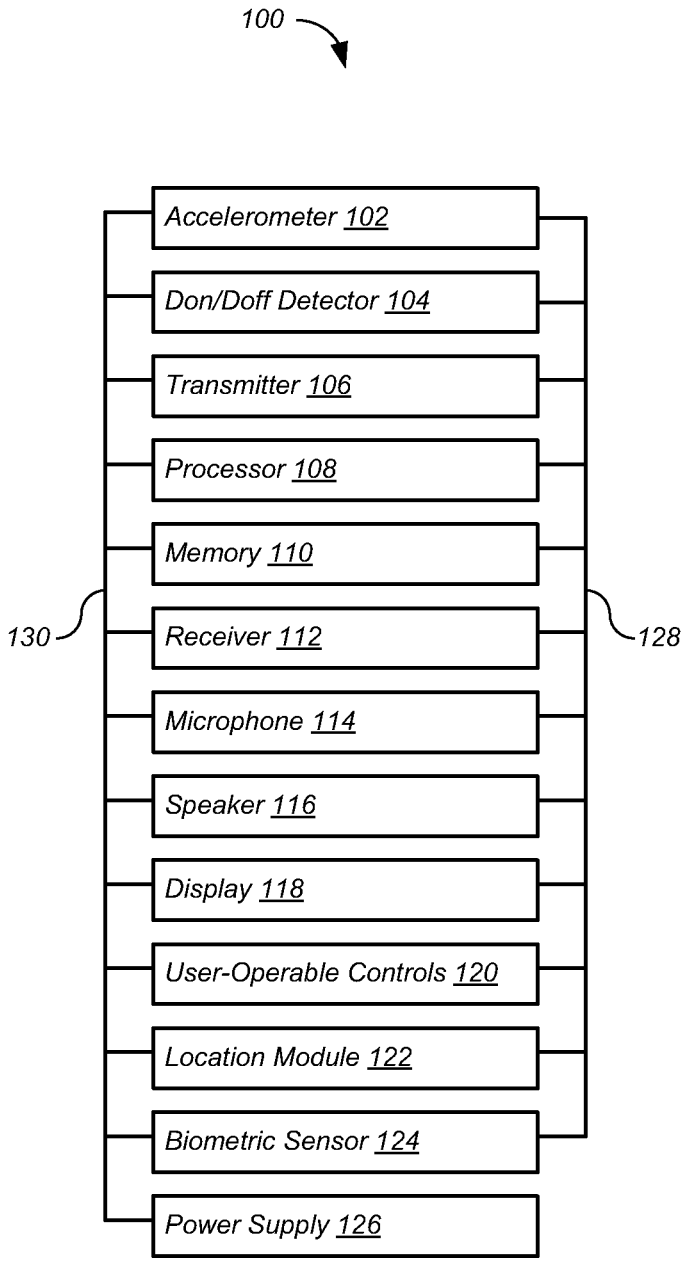
FIG. 1 shows elements of a wearable electronic communication device according to one embodiment.

The leading digit(s) of each reference numeral used in this specification indicates the number of the drawing in which the reference numeral first appears.

DETAILED DESCRIPTION

Embodiments of the present disclosure include a wearable electronic communication device. The wearable electronic communication device detects whether the wearable electronic communication device is being worn, detects a fall of the user, and transmits a message when the device is worn and a fall is detected.

Other features are contemplated as well.

FIG. 1 shows elements of a wearable electronic communication device 100 according to one embodiment. Although in the described embodiment elements of the wearable electronic communication device 100 are presented in one arrangement, other embodiments may feature other arrangements. For example, elements of the wearable electronic communication device 100 may be implemented in hardware, software, or combinations thereof. As another example, various elements of the wearable electronic communication device 100 may be implemented as one or more digital signal processors.

Referring to FIG. 1, the wearable electronic communication device 100 may include one or more of an accelerometer 102, a don/doff detector 104, a transmitter 106, and a processor 108. The wearable electronic communication device 100 may also include one or more of a memory 110, a receiver 112, a microphone 114, a speaker 116, a display 118, one or more user-operable controls 120, a location module 122, a biometric sensor 124, and a power supply 126. The wearable electronic communication device 100 may include other elements as well. The processor may communicate with other elements of the wearable electronic communication device 100 over one or more communication busses 128. The elements of wearable electronic communication device 100 may receive power from the power supply 126 over one or more power rails 130. Various elements of the wearable electronic communication device 100 may be implemented as one or more integrated circuits. The wearable electronic communication device 100 may be implemented as any wearable or part thereof. For example, the wearable electronic communication device 100 may be implemented as a headset, a bracelet, an anklet, a necklace, a ring, a wristwatch, a garment, a belt, a shoe, or the like.

The accelerometer 102 may be implemented as any sensor capable of measuring acceleration. For example, the accelerometer 102 may be implemented as a three-axis accelerometer or the like. The don/doff detector 104 may be implemented as one or more capacitive sensors or the like. The transmitter 106 and the receiver 112 may employ any communication protocol, including wired and wireless communication protocols. The wireless protocols may include Bluetooth, Wi-Fi, Digital Enhanced Cordless Telecommunications (DECT), and the like. The transmitter 106 and the receiver 112 may employ multiple communication protocols. The processor 108 may include digital signal processors, analog-to-digital converters, digital-to-analog converters, and the like.

The display 118 may be implemented as a touch screen or the like. The user-operable controls 120 may include buttons, slide switches, capacitive sensors, touch screens, and the like. The biometric sensor 124 may include any biometric sensor. For example, the biometric sensor 124 may include one or more of a heart rate monitor, a blood pressure monitor, a skin temperature monitor, a fingerprint reader, a muscle tension sensor, a skin conductivity sensor, and the like.

The location module 122 may include an e-compass, accelerometers, gyroscopes, an altimeter, and the like. The location module 122 may include a dedicated receiver to receive Global Positioning System (GPS) signals or the like, and may include a location processor to process the received signals. The location processor may employ wireless signals received by the receiver 112. The location module 122 may receive messages that include location information, and may employ those messages in location determination. In some embodiments, the location is determined by a connected device such as a smartphone or the like, or by such a connected device in conjunction with the wearable electronic communication device 100.

Figure 2:
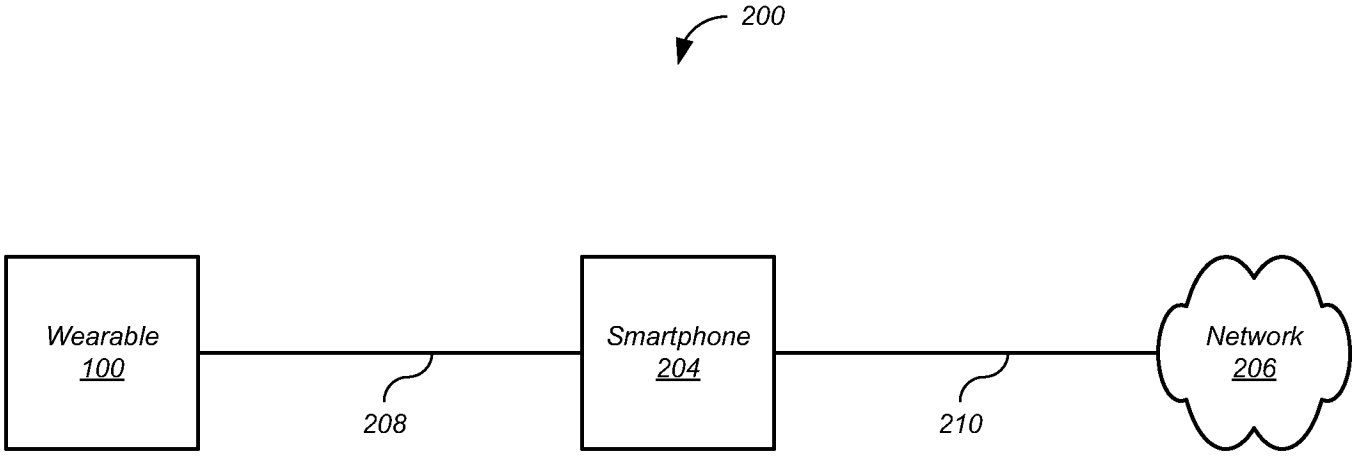
FIG. 2 shows elements of a communication system that includes the wearable electronic communication device of FIG. 1 according to one embodiment.

FIG. 2 shows elements of a communication system 200 that includes the wearable electronic communication device 100 of FIG. 1 according to one embodiment. Although in the described embodiment elements of the communication system 200 are presented in one arrangement, other embodiments may feature other arrangements. For example, elements of the communication system 200 may be implemented in hardware, software, or combinations thereof. As another example, various elements of the communication system 200 may be implemented as one or more digital signal processors.

Referring to FIG. 2, the communication system 200 may include the wearable electronic communication device 100 of FIG. 1, a smartphone 204, and a network 206. In other embodiments, the smartphone 204 may be replaced by a feature phone, a desk phone, a soft phone, a computer, and the like. The network 206 may be a mobile network, a computer network or the like. The wearable electronic communication device 100 and the smartphone 204 may communicate over a channel 208 such as a wireless link, a wired link, or the like. The wireless link may be a Bluetooth link, a Digital Enhanced Cordless Telecommunications (DECT) link, a Wi-Fi link, or the like. The smartphone 204 and the network 206 may communicate over a channel 210. The wearable electronic communication device 100 may exchange audio, status messages, command messages, and the like with the smartphone 204 over the channel 208. The smartphone 204 may exchange audio, status messages, and command messages with the network 206 over the channel 210.

Figure 3:
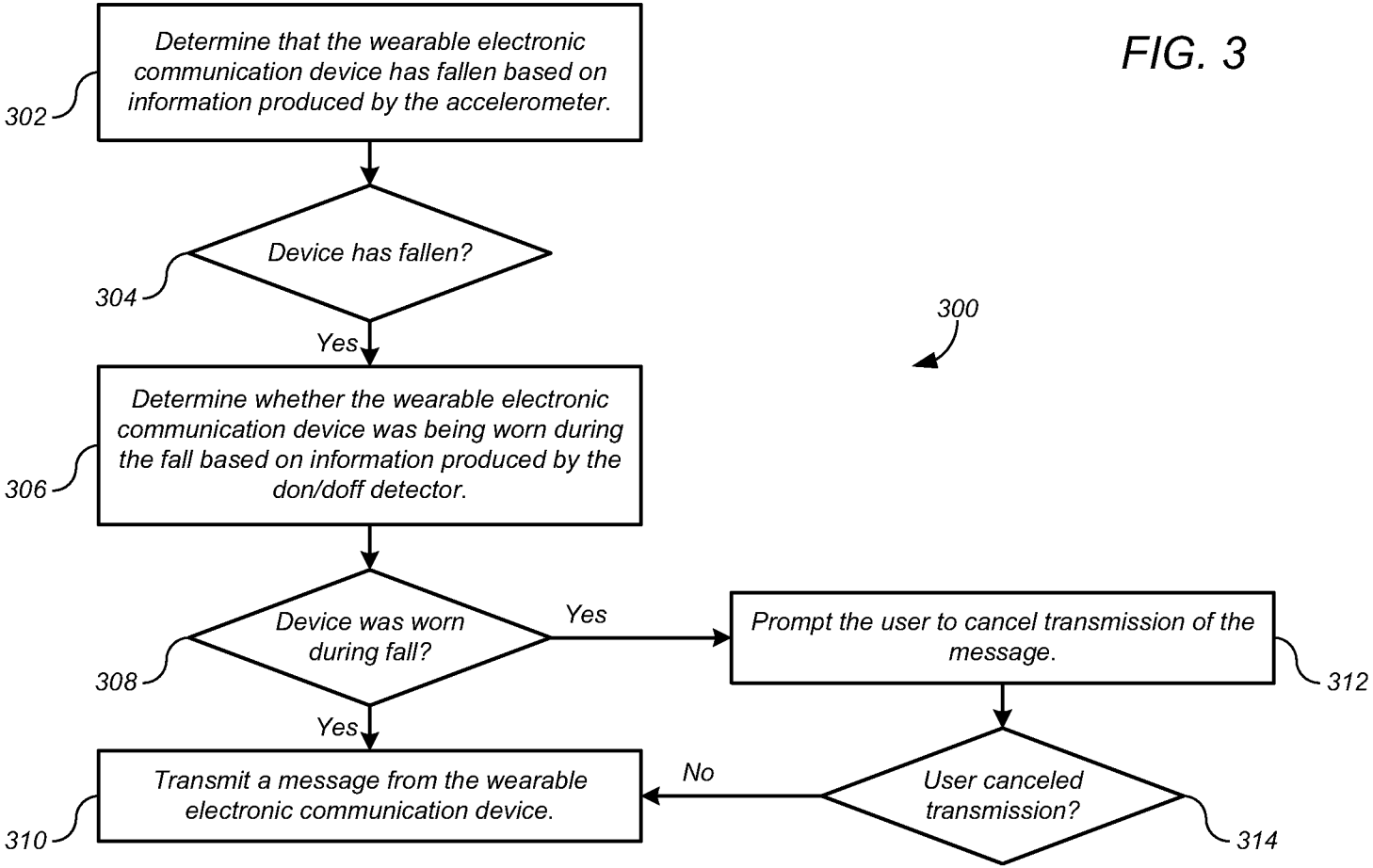
FIG. 3 shows a process for the wearable electronic communication device of FIGS. 1 and 2 according to one embodiment.

FIG. 3 shows a process 300 for the wearable electronic communication device 100 of FIGS. 1 and 2 according to one embodiment. Although in the described embodiments the elements of process 300 are presented in one arrangement, other embodiments may feature other arrangements. For example, in various embodiments, some or all of the elements of process 300 can be executed in a different order, concurrently, and the like. Also some elements of process 300 may not be performed, and may not be executed immediately after each other. In addition, some or all of the elements of process 300 can be performed automatically, that is, without human intervention.

Referring to FIG. 3, at 302, the processor 108 may determine whether the wearable electronic communication device 100 has fallen based on information produced by the accelerometer 102. For example, the information produced by the accelerometer 102 may indicate the wearable electronic communication device 100 has experienced free fall, followed by an impact, followed by motionlessness. In various embodiments, the processor 108 may determine that the wearable electronic communication device 100 has fallen based on one or more of these indications, taken in various combinations and various orders of occurrence. The processor 108 may consider the presence or absence of an indication, as well as a degree of the indication. For example, the processor may consider the duration of the free fall, the severity of the impact, the duration of motionlessness, and the like.

At 304, if the processor 108 determines that the wearable electronic communication device 100 has fallen, then at 306 the processor 108 may determine whether the wearable electronic communication device 100 was being worn during the fall based on information produced by the don/doff detector 104. This determination may distinguish a fall of the user from a fall of the wearable electronic communication device 100 alone, for example to identify cases where the wearable electronic communication device 100 has been dropped, thrown, or the like.

In some falls, the wearable electronic communication device 100 may separate from the user during the fall, on impact, or the like. For example, a cyclist wearing a headset may hit a bump in a trail that causes the headset to separate from the cyclist during a resulting fall. Thus determining that the wearable electronic communication device 100 was being worn during the fall includes the case where the wearable electronic communication device 100 was worn only during a portion of the fall.

At 308, if the processor 108 determines that the wearable electronic communication device 100 was being worn during the fall, then at 310 the processor 108 causes the transmitter 106 to transmit a message from the wearable electronic communication device 100. Any message may be used. For example, the message may instruct the smartphone 204 or other connected devices to transmit a message, make a phone call, display specified information, announce the information over a speaker, or the like. The message transmitted by the smartphone 204 may be an email, text message or the like. The message transmitted by the wearable electronic communication device 100 may include one or more phone numbers to be called. Multiple phone numbers may be called in round-robin fashion. The one or more phone numbers may be stored in the memory 110 of the wearable electronic communication device 100, in a memory of the smartphone 204, or the like. The message transmitted by the wearable electronic communication device 100, and the message transmitted by the smartphone 204, may include information such as the duration of the free fall, the severity of the impact, the duration of motionlessness, and the like. These messages may also include information that represents the location of the wearable electronic communication device 100 and/or the smartphone 204. These messages may also include biometric information collected by the biometric sensor 124 of the wearable electronic communication device 100. In embodiments making phone calls, any of the above information may be played as speech during the phone call. In embodiments displaying information, any of the above information may be displayed by a display of the smartphone 204, or the like. In embodiments announcing information, any of the above information may be played as speech over a speaker of the smartphone 204, or the like. Any of the speech may be generated by a speech synthesizer executed by the processor 108 of the wearable electronic communication device 100, by a processor of the smartphone 204, or the like. For example, the smartphone 204 may display and/or announce emergency information such as the name of the user, emergency contact information, a doctor's contact information, drug allergies of the user, medical conditions of the user, and the like, thereby making this information immediately available to a first responder.

In some embodiments, the wearable electronic communication device 100 allows the user to cancel transmission of the message or phone call. If the user is unwilling or unable to cancel transmission of the message or the phone call, the message or phone call is transmitted. In such embodiments, at 312, the processor 108 causes the wearable electronic communication device 100 to prompt the user to cancel transmission of the message or the phone call. For example, the processor 108 may cause the speaker 116 in the wearable electronic communication device 100 to generate an audible message such as "calling 911 in 60 seconds unless the call button is pressed." This prompt may take any form. For example, the prompt may be an audible message, a visual message generated on a display 118 of the wearable electronic communication device 100 or on a display of the smartphone 204, or the like. At 314, if the user does not cancel transmission of the message, then at 310 the processor 108 causes the transmitter 106 to transmit the message from the wearable electronic communication device 100.

In some embodiments, at 308, if the processor 108 determines that the wearable electronic communication device 100 was not being worn during the fall, then the processor 108 may conduct a self-test of the wearable electronic communication device 100. When the wearable electronic communication device 100 is subsequently donned, the processor 108 may cause the wearable electronic communication device 100 to play a message for the user. For example, the message may state "your device experienced a fall and the self-test confirms it is in complete working condition."

Various embodiments of the present disclosure can be implemented in digital electronic circuitry, or in computer hardware, firmware, software, or in combinations thereof. Embodiments of the present disclosure can be implemented in a computer program product tangibly embodied in a computer-readable storage device for execution by a programmable processor. The described processes can be performed by a programmable processor executing a program of instructions to perform functions by operating on input data and generating output. Embodiments of the present disclosure can be implemented in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object-oriented programming language, or in assembly or machine language if desired; and in any case, the language can be a compiled or interpreted language. Suitable processors include, by way of example, both general and special purpose microprocessors. Generally, processors receive instructions and data from a read-only memory and/or a random access memory. Generally, a computer includes one or more mass storage devices for storing data files. Such devices include magnetic disks, such as internal hard disks and removable disks, magneto-optical disks; optical disks, and solid-state disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits). As used herein, the term "module" may refer to any of the above implementations.

A number of implementations have been described. Nevertheless, various modifications may be made without departing from the scope of the disclosure. Accordingly, other implementations are within the scope of the following claims.

What is claimed is:

1. A wearable electronic communication device comprising:

an accelerometer;

a don/doff detector;

a transmitter;

a processor configured to i) determine that the wearable electronic communication device has experienced a fall based on information produced by the accelerometer, ii) in response to determining that the wearable electronic communication device has experienced the fall based on the information produced by the accelerometer, determine that the wearable electronic communication device was being worn during the fall by determining that the wearable electronic communication device was being worn during a first portion of the fall but not being worn during a second portion of the fall based on information produced by the don/doff detector, and iii) cause the transmitter to transmit a message from the wearable electronic communication device responsive to the processor determining both i) the wearable electronic communication device has experienced the fall and ii) the wearable electronic communication device was being worn during the fall, wherein the message includes information that represents a location.

2. The wearable electronic communication device of claim 1, wherein:

the message is a first message; and the first message instructs a connected device to transmit a second message.

3. The wearable electronic communication device of claim 1, further comprising:

a memory configured to store a phone number;

wherein the message instructs a connected device to call the phone number.

4. The wearable electronic communication device of claim 1, wherein:

the processor is further configured to determine a severity of the fall based on the information produced by the accelerometer.

5. The wearable electronic communication device of claim 4, wherein:

the transmitter is further configured to transmit the message only responsive to the determined severity of the fall exceeding a threshold severity.

6. The wearable electronic communication device of claim 4, wherein the message includes information representing the severity of the fall.

7. The wearable electronic communication device of claim 1, further comprising:

a biometric sensor;

wherein the message includes information collected by the biometric sensor.

8. The wearable electronic communication device of claim 1:

wherein the processor is further configured to a) cause the wearable electronic communication device to prompt a user to cancel transmission of the message, and b) cause the transmitter to transmit the message responsive to the user not cancelling transmission of the message.

9. The wearable electronic communication device of claim 1, wherein the wearable electronic communication device is a headset.

10. Computer-readable media embodying instructions executable by a computer in a wearable electronic communication device to perform functions comprising:

determining that the wearable electronic communication device has experienced a fall based on information produced by an accelerometer of the wearable electronic communication device;

in response to determining that the wearable electronic communication device has experienced the fall based on the information produced by the accelerometer, determining that the wearable electronic communication device was being worn during the fall by determining that the wearable electronic communication device was being worn during a first portion of the fall but not being worn during a second portion of the fall based on information produced by a don/doff detector of the wearable electronic communication device; and causing a transmitter of the wearable electronic communication device to transmit a message from the wearable electronic communication device responsive to determining both i) the wearable electronic communication device has experienced the fall and ii) the wearable electronic communication device was being worn during the fall, wherein the message includes information that represents a location.

11. The computer-readable media of claim 10, wherein:

the message is a first message; and the first message instructs a connected device to transmit a second message.

12. The computer-readable media of claim 10, wherein the functions further comprise:

storing a phone number in a memory of the wearable electronic communication device;

wherein the message instructs a connected device to call the phone number.

13. The computer-readable media of claim 10, wherein the functions further comprise:

determining a severity of the fall based on the information produced by the accelerometer.

14. The computer-readable media of claim 13, wherein the functions further comprise:

transmitting the message only responsive to the determined severity of the fall exceeding a threshold severity.

15. The computer-readable media of claim 13, wherein the message includes information representing the severity of the fall.

16. The computer-readable media of claim 10, wherein:

the message includes information collected by a biometric sensor of the wearable electronic communication device.

17. The computer-readable media of claim 10, wherein the functions further comprise:

causing the wearable electronic communication device to prompt a user to cancel transmission of the message, and causing the transmitter to transmit the message only responsive to the user not cancelling transmission of the message.

18. A method for a wearable electronic communication device, the method comprising:

determining that the wearable electronic communication device has experienced a fall based on information produced by an accelerometer of the wearable electronic communication device;

in response to determining that the wearable electronic communication device has experienced the fall based on the information produced by the accelerometer, determining that the wearable electronic communication device was being worn during the fall by determining that the wearable electronic communication device was being worn during a first portion of the fall but not being worn during a second portion of the fall based on information produced by a don/doff detector of the wearable electronic communication device; and transmitting a message from the wearable electronic communication device responsive to determining both i) the wearable electronic communication device has experienced the fall and ii) the wearable electronic communication device was being worn during the fall, wherein the message includes information that represents a location.

19. The wearable electronic communication device of claim 1, wherein the don/doff detector includes one or more capacitive sensors.

20. The wearable electronic communication device of claim 8, wherein causing the wearable electronic communication device to prompt the user to cancel the transmission of the message includes causing a visual message to be generated on a display of a wirelessly connected device.

* * * * *